US009786224B2

(12) United States Patent
Kim et al.

(10) Patent No.: US 9,786,224 B2
(45) Date of Patent: Oct. 10, 2017

(54) ORGANIC LIGHT EMITTING DIODE DISPLAY

(71) Applicant: SAMSUNG DISPLAY CO., LTD., Yongin, Gyeonggi-Do (KR)

(72) Inventors: Chang-Yeop Kim, Cheonan-si (KR); Ji Hye Kim, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 149 days.

(21) Appl. No.: 14/702,602

(22) Filed: May 1, 2015

(65) Prior Publication Data

US 2016/0133190 A1 May 12, 2016

(30) Foreign Application Priority Data

Nov. 10, 2014 (KR) ..... 10-2014-0155502

(51) Int. Cl.
*G09G 3/32* (2016.01)
*G09G 3/3258* (2016.01)
*G09G 3/20* (2006.01)

(52) U.S. Cl.
CPC ..... *G09G 3/3258* (2013.01); *G09G 3/2011* (2013.01); *G09G 2300/0404* (2013.01);
(Continued)

(58) Field of Classification Search
CPC ..... G09G 3/3258; G09G 3/2011; G09G 2300/0819; G09G 2310/0216;
(Continued)

(56) References Cited

U.S. PATENT DOCUMENTS

2006/0044230 A1* 3/2006 Eom ..... G09G 3/3233 345/76
2006/0125807 A1* 6/2006 Park ..... G09G 3/3233 345/204
(Continued)

FOREIGN PATENT DOCUMENTS

JP 4801794 B2 8/2011
KR 10-2011-0036456 A 4/2011
(Continued)

*Primary Examiner* — Andrew Sasinowski
(74) *Attorney, Agent, or Firm* — Lewis Roca Rothgerber Christie LLP

(57) ABSTRACT

An organic light emitting diode display includes: a substrate; a scan line, a first emission control line, and a second emission control line on the substrate; a data line and a driving voltage line crossing the scan line; a switching transistor connected to the scan line and the data line and including a switching drain electrode; a driving transistor including a driving source electrode connected to the switching drain electrode; an organic light emitting diode electrically connected to a driving drain electrode of the driving transistor; an operation control transistor to transmit a driving voltage to the driving transistor; and a first emission control transistor and second emission control transistor to transmit the driving voltage from the driving transistor to the organic light emitting diode, wherein the first emission control line and the second emission control line partially overlap each other.

13 Claims, 11 Drawing Sheets

(52) U.S. Cl.
CPC ..... *G09G 2300/0819* (2013.01); *G09G 2300/0842* (2013.01); *G09G 2310/0216* (2013.01); *G09G 2310/0251* (2013.01); *G09G 2320/0257* (2013.01); *G09G 2320/045* (2013.01)

(58) Field of Classification Search
CPC ..... G09G 2310/0251; G09G 2320/045; G09G 2320/0257; G09G 2300/0404; G09G 2300/0842
See application file for complete search history.

(56) References Cited

U.S. PATENT DOCUMENTS

| | | | | |
|---|---|---|---|---|
| 2011/0128211 | A1 | 6/2011 | Ono | |
| 2013/0141316 | A1* | 6/2013 | Lee | G09G 3/3266 345/76 |
| 2013/0208032 | A1* | 8/2013 | Jang | G09G 3/3233 345/694 |
| 2014/0176523 | A1* | 6/2014 | Kwak | G09G 3/3233 345/212 |
| 2016/0063922 | A1* | 3/2016 | Tsai | G09G 3/3233 345/76 |

FOREIGN PATENT DOCUMENTS

| | | | |
|---|---|---|---|
| KR | 10-2013-0019119 | A | 2/2013 |
| KR | 10-2013-0092229 | A | 8/2013 |

* cited by examiner

ORGANIC LIGHT EMITTING DIODE DISPLAY

CROSS-REFERENCE TO RELATED APPLICATION

This application claims priority to and the benefit of Korean Patent Application No. 10-2014-0155502 filed in the Korean Intellectual Property Office on Nov. 10, 2014, the entire contents of which are incorporated herein by reference.

BACKGROUND

1. Field

The present disclosure relates to an organic light emitting diode display.

2. Description of the Related Art

An organic light emitting diode (OLED) display includes two electrodes and an organic emission layer interposed therebetween. Electrons injected from one electrode (e.g., a cathode) and holes injected from the other electrode (e.g., an anode) are combined in the organic emission layer to generate excitons, and the excitons release energy to emit light.

The organic light emitting diode display includes a plurality of pixels, each of the pixels including an organic light emitting diode that is formed of a cathode, an anode, and an organic emission layer, and a plurality of transistors and capacitors for driving the organic light emitting diode are formed in each pixel. The plurality of transistors include a switching transistor and a driving transistor.

In the driving transistor, hysteresis, which is a phenomenon in which a gate-source voltage Vgs is changed when a white voltage is changed to a black voltage and the black voltage is changed into the white voltage, may cause afterimages to be generated in the organic light emitting diode display.

The above information disclosed in this Background section is only for enhancement of understanding of the background of the disclosure and therefore it may contain information that does not form prior art.

SUMMARY

One or more embodiments of the present disclosure provide an organic light emitting diode display in which afterimages are not generated and resolution is improved.

An organic light emitting diode display according to an exemplary embodiment of the present disclosure includes: a substrate; a scan line, a first emission control line, and a second emission control line on the substrate and respectively configured to transmit a scan signal, a first emission control signal, and a second emission control signal; a data line and a driving voltage line crossing the scan line, the data line and the driving voltage line being respectively configured to transmit a data voltage and a driving voltage; a switching transistor connected to the scan line and the data line and including a switching drain electrode configured to output the data voltage; a driving transistor including a driving source electrode connected to the switching drain electrode; an organic light emitting diode electrically connected to a driving drain electrode of the driving transistor; an operation control transistor configured to be turned on by the first emission control signal and to transmit the driving voltage to the driving transistor; and a first emission control transistor and a second emission control transistor respectively configured to be turned on by the first emission control signal and the second emission control signal, and to transmit the driving voltage from the driving transistor to the organic light emitting diode, wherein the first emission control line and the second emission control line partially overlap each other.

The second emission control line may be between the first emission control line and the organic light emitting diode.

The second emission control transistor may be configured to receive the second emission control signal having a high level through the second emission control line during an initialization period in which the driving transistor is initialized to turn off the second emission control transistor.

The organic light emitting diode display may further include a storage capacitor including a first storage electrode connected to a driving gate electrode of the driving transistor, and a second storage electrode connected to the driving voltage line, wherein the first emission control line may be at a same layer as the first storage electrode.

The second emission control line may be at a same layer as the scan line.

The second storage electrode and the driving gate electrode may be at a same layer as the scan line.

A first emission control gate electrode of the first emission control transistor and a second emission control gate electrode of the second emission control transistor may partially overlap each other.

An organic light emitting diode display according to another exemplary embodiment of the present disclosure includes: a substrate; a scan line and an emission control line on the substrate and respectively configured to transmit a scan signal and an emission control signal; a data line and a driving voltage line crossing the scan line, the data line and the driving voltage line being respectively configured to transmit a data voltage and a driving voltage; a switching transistor connected to the scan line and the data line and including a switching drain electrode configured to output the data voltage; a driving transistor including a driving source electrode connected to the switching drain electrode; an organic light emitting diode electrically connected to a driving drain electrode of the driving transistor; an operation control transistor configured to be turned on by the emission control signal and to transmit the driving voltage to the driving transistor; an emission control transistor configured to be turned on by the emission control signal and to transmit the driving voltage from the driving transistor to the organic light emitting diode; and a holding electrode line including a holding electrode overlapping the driving source electrode and the driving drain electrode, wherein the driving source electrode, the driving drain electrode, and the holding electrode, form a holding capacitor.

The holding electrode line may be connected to the emission control line.

The organic light emitting diode display may further include: a storage capacitor including a first storage electrode connected to a driving gate electrode of the driving transistor, and a second storage electrode connected to the driving voltage line, wherein the emission control line may be at a same layer as the first storage electrode.

The holding electrode line may be at a same layer as the second storage electrode.

The driving gate electrode may be at a same layer as the emission control line.

The holding electrode may include a first holding electrode overlapping the driving source electrode and a second holding electrode overlapping the driving drain electrode, wherein the holding capacitor may include a first holding capacitor between the driving source electrode and the first holding electrode, and a second holding capacitor between the driving drain electrode and the second holding electrode.

According to one or more embodiments of the present disclosure, by forming the second emission control line between the first emission control line and the organic light emitting diode, and applying the second emission control signal of the high level to the second emission control transistor through the second emission control line during the initialization period, the driving transistor may maintain the state in which the driving channel is formed during the initialization period, such that the afterimage caused by the hysteresis of the driving transistor may be prevented or substantially prevented.

Further, by forming the first emission control line and the second emission control line to be partially overlapped, the inner space of the pixel may be minimized or reduced, such that the pixel size may be minimized or reduced, thereby realizing high resolution.

In addition, by forming the holding capacitor including the emission control line and the holding electrode overlapping thereto, the afterimage due to the parasitic capacitance between the driving gate electrode, and the driving source electrode and the driving drain electrode may be prevented or substantially prevented.

DETAILED DESCRIPTION

Figure 1:
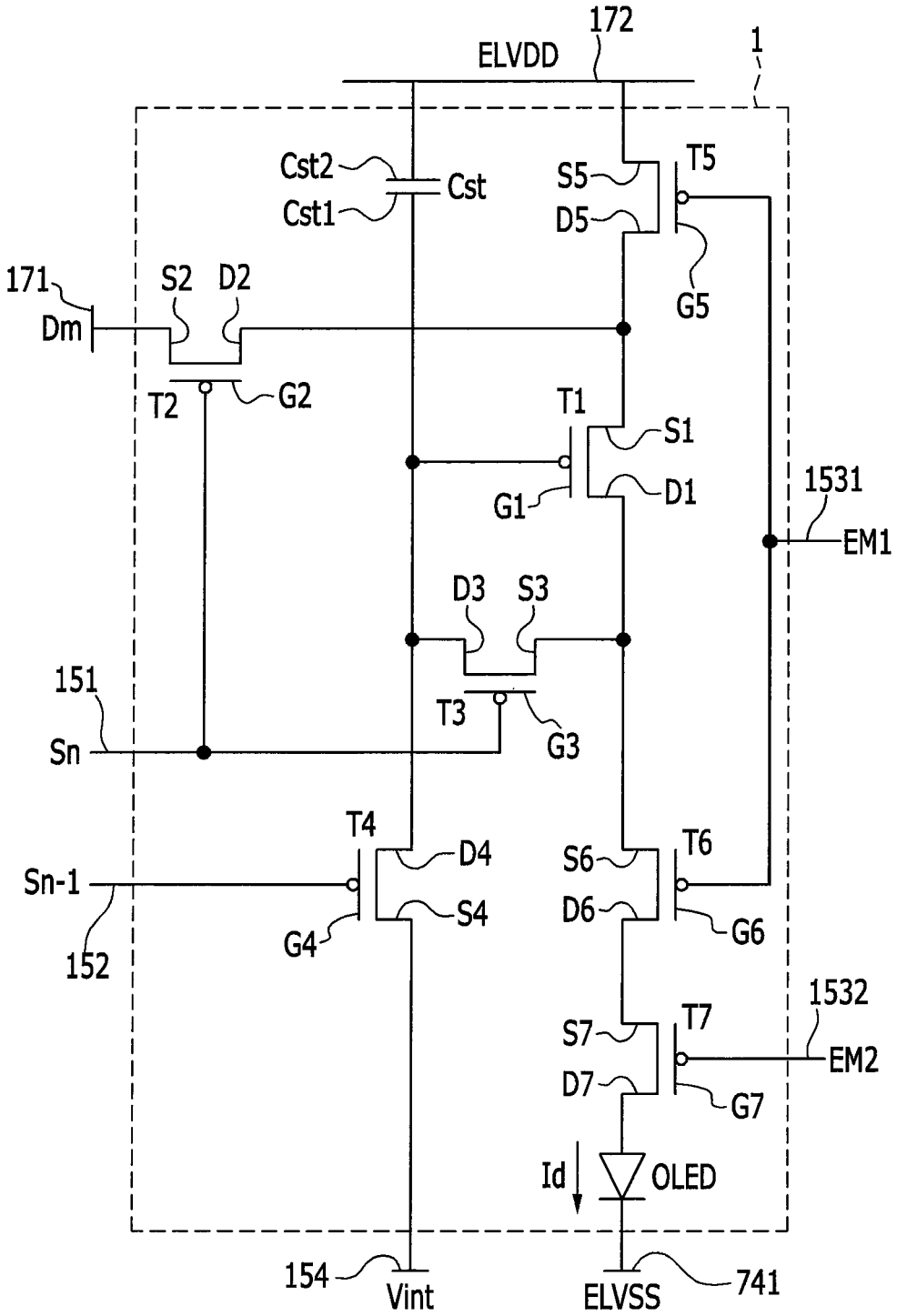
FIG. 1 is an equivalent circuit diagram of one pixel of an organic light emitting diode display according to an exemplary embodiment of the present disclosure.

The present disclosure will be described more fully hereinafter with reference to the accompanying drawings, in which exemplary embodiments of the invention are shown. As those skilled in the art would realize, the described embodiments may be modified in various different ways, all without departing from the spirit and scope of the present invention.

Descriptions of parts not related to the present disclosure are omitted, and like reference numerals designate like elements throughout the specification.

Further, since sizes and thicknesses of constituent members shown in the accompanying drawings may be exaggerated for better understanding and ease of description, the present disclosure is not limited to the illustrated sizes and thicknesses.

In the drawings, the thickness of layers, films, panels, regions, etc., are exaggerated for clarity. In the drawings, for better understanding and ease of description, the thicknesses of some layers and areas are exaggerated. It will be understood that when an element such as a layer, film, region, or substrate is referred to as being "on," "connected to," or "coupled to" another element, it can be directly on, connected to, or coupled to the other element, or one or more intervening elements may be present. Further, in the specification, the word "on" refers to positioning on or below the object portion, and should not be limited to positioning on the upper side of the object portion based on a gravity direction. In addition, it will also be understood that when an element or layer is referred to as being "between" two elements or layers, it can be the only element or layer between the two elements or layers, or one or more intervening elements or layers may also be present.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

In addition, unless explicitly described to the contrary, the words "comprise" or "include," and variations such as "comprises," "comprising," "includes," or "including," will be understood to imply the inclusion of the stated elements but not the exclusion of any other elements.

Further, in the specification, the phrase "in a plan view" refers to an object portion viewed from above, and the phrase "in a cross-section" refers to a cross-section taken by vertically cutting an object portion and viewed from the side.

As used herein, the singular forms "a" and "an" are intended to include the plural forms as well, unless the context clearly indicates otherwise. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Now, an organic light emitting diode display according to an exemplary embodiment of the present disclosure will be described with reference to FIG. 1 to FIG. 7.

FIG. 1 is an equivalent circuit diagram of one pixel of an organic light emitting diode display according to an exemplary embodiment of the present disclosure.

As shown in FIG. 1, one pixel 1 of an organic light emitting diode display according to an exemplary embodiment of the present disclosure includes a plurality of signal lines 151, 152, 1531, 1532, 154, 171, and 172, a plurality of transistors (e.g., thin film transistors) T1, T2, T3, T4, T5, T6, and T7 connected to the plurality of signal lines, a storage capacitor Cst, and an organic light emitting diode OLED.

The transistors T1, T2, T3, T4, T5, T6, and T7 include a driving transistor T1, a switching transistor T2, a compensation transistor T3, an initialization transistor T4, an operation control transistor T5, a first emission control transistor T6, and a second emission control transistor T7.

The signal lines 151, 152, 1531, 1532, 154, 171, and 172 include a scan line 151 for transmitting a scan signal Sn, a previous scan line 152 for transmitting a previous scan signal Sn−1 to the initialization transistor T4, a first emission control line 1531 for transmitting a first emission control signal EM1 to the operation control transistor T5 and the first emission control transistor T6, a second emission control line 1532 for transmitting a second emission control signal EM2 to the second emission control transistor T7, a data line 171 crossing the scan line 151 and for transmitting a data signal Dm, a driving voltage line 172 for transmitting a driving voltage ELVDD and being parallel or substantially parallel to the data line 171, and an initialization voltage line 154 for transmitting an initialization voltage Vint for initializing the driving transistor T1.

A gate electrode G1 of the driving transistor T1 is connected to one end (e.g., one electrode) Cst1 of the storage capacitor Cst, a source electrode S1 of the driving transistor T1 is connected to the driving voltage line 172 via the operation control transistor T5, and a drain electrode D1 of the driving transistor T1 is electrically connected to an anode of the organic light emitting diode OLED via the first emission control transistor T6 and the second emission control transistor T7. The driving transistor T1 receives the data signal Dm according to a switching operation of the switching transistor T2, and supplies a driving current Id to the organic light emitting diode OLED.

A gate electrode G2 of the switching transistor T2 is connected to the scan line 151, a source electrode S2 of the switching transistor T2 is connected to the data line 171, and a drain electrode D2 of the switching transistor T2 is connected to the source electrode S1 of the driving transistor T1 and to the driving voltage line 172 via the operation control transistor T5. The switching transistor T2 is turned on according to the scan signal Sn received through the scan line 151 to perform a switching operation for transferring the data signal Dm transferred through the data line 171 to the source electrode of the driving transistor T1.

A gate electrode G3 of the compensation transistor T3 is connected (e.g., directly connected) to the scan line 151, a source electrode S3 of the compensation transistor T3 is connected to the drain electrode D1 of the driving transistor T1 and to the anode of the organic light emitting diode OLED via the first emission control transistor T6 and the second emission control transistor T7, and a drain electrode D3 of the compensation transistor T3 is connected to the one end Cst1 of the storage capacitor Cst, a drain electrode D4 of the initialization transistor T4, and the gate electrode G1 of the driving transistor T1, together. The compensation transistor T3 is turned on according to the scan signal Sn received through the scan line 151 to connect the gate electrode G1 to the drain electrode D1 of the driving transistor T1 to diode-connect the driving transistor T1.

A gate electrode G4 of the initialization transistor T4 is connected to the previous scan line 152, a source electrode S4 of the initialization transistor T4 is connected to the initialization voltage line 154, and the drain electrode D4 of the initialization transistor T4 is connected to the one end Cst1 of the storage capacitor Cst, the drain electrode D3 of the compensation transistor T3, and the gate electrode G1 of the driving transistor T1 together. The initialization transistor T4 is turned on according to the previous scan signal Sn−1 received through the previous scan line 152 to transfer the initialization voltage Vint to the gate electrode G1 of the driving transistor T1, and to perform an initialization operation for initializing a voltage of the gate electrode G1 of the driving transistor T1.

A gate electrode G5 of the operation control transistor T5 is connected to the first emission control line 1531, a source electrode S5 of the operation control transistor T5 is connected to the driving voltage line 172, and a drain electrode D5 of the operation control transistor T5 is connected to the source electrode S1 of the driving transistor T1 and the drain electrode S2 of the switching transistor T2.

A gate electrode G6 of the first emission control transistor T6 is connected to the first emission control line 1531, the source electrode S6 of the first emission control transistor T6 is connected to the drain electrode D1 of the driving transistor T1 and the source electrode S3 of the compensation transistor T3, and the drain electrode D6 of the first emission control transistor T6 is connected to a source electrode S7 of the second emission control transistor T7.

A gate electrode G7 of the second emission control transistor T7 is connected to the second emission control line 1532, the source electrode S7 of the second emission control transistor T7 is connected to the drain electrode D6 of the first emission control transistor T6, and a drain electrode D7 of the second emission control transistor T7 is electrically connected to the anode of the organic light emitting diode OLED.

The operation control transistor T5 and the first emission control transistor T6 are concurrently (e.g., simultaneously) turned on according to the first emission control signal EM1 transmitted through the first emission control line 1531, and the second emission control transistor T7 is turned on according to the second emission control signal EM2 transmitted through the second emission control line 1532, such that the driving voltage ELVDD is compensated through the diode-connected driving transistor T1 and is transmitted to the organic light emitting diode OLED.

Another end (e.g., another electrode) Cst2 of the storage capacitor Cst is connected to the driving voltage line 172, and a cathode of the organic light emitting diode OLED is connected to a common voltage line 741 for transmitting a common voltage ELVSS.

Next, a detailed operation process of the one pixel of the organic light emitting diode display according to an exemplary embodiment of the present disclosure will be described in detail with reference to FIG. 2.

Figure 2:
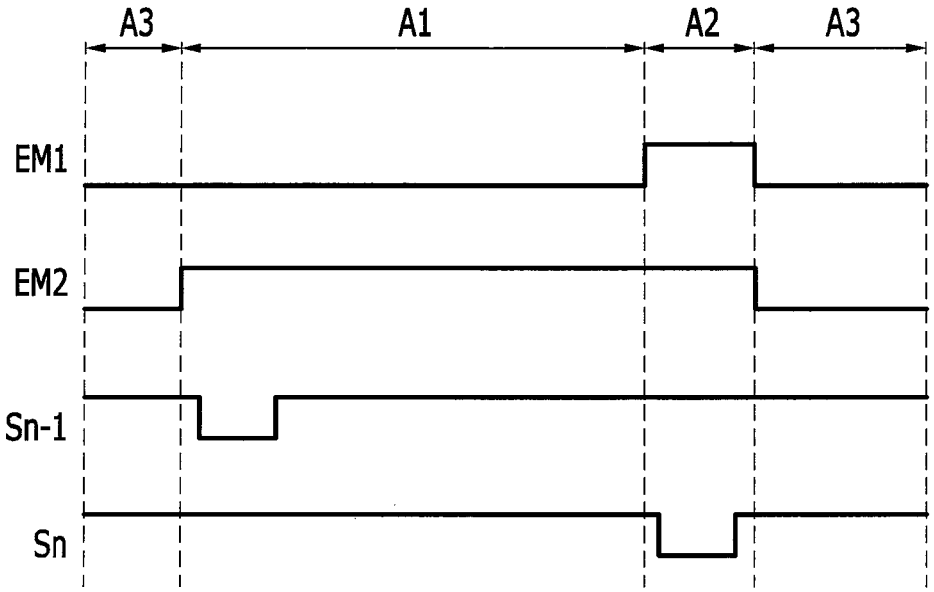
FIG. 2 is a timing diagram of signals applied to one pixel of an organic light emitting diode display according to an exemplary embodiment of the present disclosure.

FIG. 2 is a timing diagram of signals applied to the one pixel of an organic light emitting diode display according to an exemplary embodiment of the present disclosure.

As shown in FIG. 2, first, during an initializing period A1, the previous scan signal Sn−1 having a low level is supplied through the previous scan line 152. In this case, the first emission control signal EM1 of a low level is previously applied through the first emission control line 1531, and the second emission control signal EM2 of a high level is then applied through the second emission control line 1532, while the first emission control signal EM1 of the low level is being applied. Then, the initializing thin film transistor T4 is turned on in response to the previous scan signal Sn−1 having the low level, the initial voltage Vint is transmitted to the gate electrode of the driving transistor T1 from the initialization voltage line 154 through the initializing thin film transistor T4, and the driving transistor T1 is initialized by the initialization voltage Vint. In this case, the second emission control signal EM2 of the high level is applied to the gate electrode G7 of the second emission control transistor T7, such that the second emission control transistor T7 is in a turn-off state. Accordingly, a driving channel is formed in the driving transistor T1, and the driving voltage ELVDD is applied to the source electrode S1 and the drain electrode D1. The second emission control transistor T7 connected between the first emission control transistor T6 and the organic light emitting diode OLED is in the turn-off state, such that the driving transistor T1 maintains the driving channel formed with a large gate-source voltage Vgs corresponding to the difference between the initialization voltage Vint and the driving voltage ELVDD. Accordingly, afterimages (e.g., burned in images) that are generated by hysteresis may be minimized or reduced.

Thereafter, during a data programming period A2, the scan signal Sn having a low level is supplied through the scan line 151. Then, the switching transistor T2 and the compensating transistor T3 are turned on in response to the scan signal Sn having the low level. At this time, the driving transistor T1 is diode-connected through the turned on compensation transistor T3, and is biased in a forward direction.

Then, a compensation voltage Dm+Vth (Vth is a negative (−) value) corresponding to the data signal Dm supplied from the data line 171 that is reduced by a threshold voltage Vth of the driving transistor T1 is applied to the gate electrode G1 of the driving transistor T1. The driving voltage ELVDD and the compensation voltage Dm+Vth are applied respectively to terminals Cst2 and Cst1 of the storage capacitor Cst, and a charge corresponding to a voltage difference between the terminals Cst2 and Cst1 is stored in the storage capacitor Cst.

Next, during an emission period A3, the first emission control signal EM1 supplied from the first emission control line 1531 is changed from the high level to the low level, and the second emission control signal EM2 supplied through the second emission control line 1532 is changed from the high level to the low level. Thus, during the emission period A3, the operation control transistor T5, the first emission control transistor T6, and the second emission control transistor T7 are turned on by the first emission control signal EM1 and the second emission control signal EM2 having the low levels.

Then, a driving current Id is generated according to the voltage difference between the gate voltage of the gate electrode G1 of the driving transistor T1 and the driving voltage ELVDD, and the driving current Id is supplied to the organic light emitting diode OLED through the first emission control transistor T6 and the second emission control transistor T7. The gate-source voltage Vgs of the driving transistor T1 is maintained as "(Dm+Vth)-ELVDD" by the storage capacitor Cst for the emission period, and according to a current-voltage relationship of the driving transistor T1, the driving current Id is proportional to a value obtained by subtracting the threshold voltage Vth from the source-gate voltage and squaring the value "$(Dm-ELVDD)^2$". Accordingly, the driving current Id is determined regardless of the threshold voltage Vth of the driving transistor T1.

In the above-described exemplary embodiment of the present disclosure, a structure of seven transistors and one capacitor is shown. However, the present disclosure is not limited thereto, and a number of transistors and a number of capacitors may be variously changed.

Next, a detailed structure of the pixel of the organic light emitting diode display illustrated in FIG. 1 will be described in more detail with reference to FIG. 1 and FIG. 3 to FIG. 7.

Figure 3:
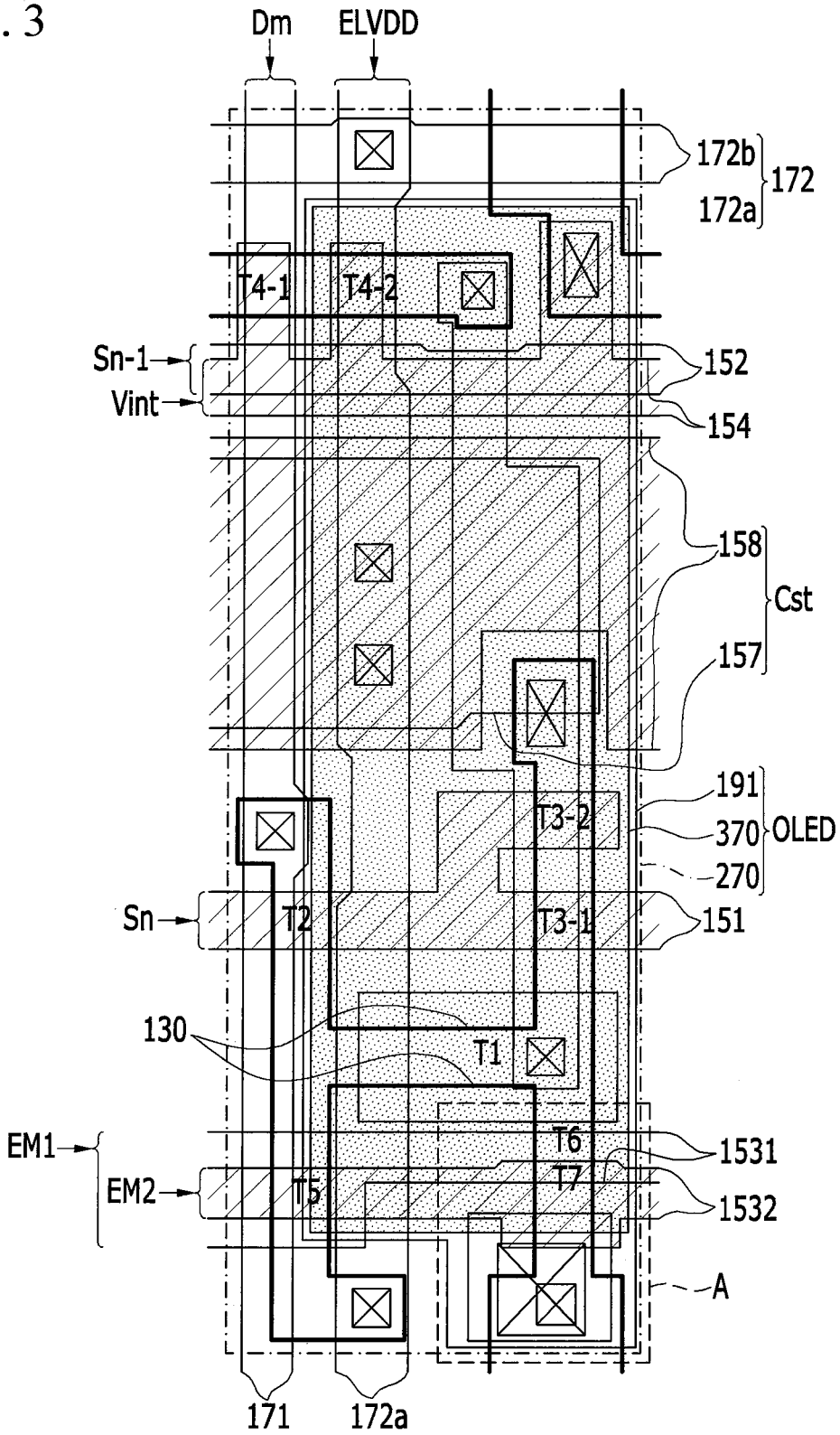
FIG. 3 is a schematic view of a plurality of transistors and capacitors of an organic light emitting diode display according to an exemplary embodiment of the present disclosure.
Figure 4:
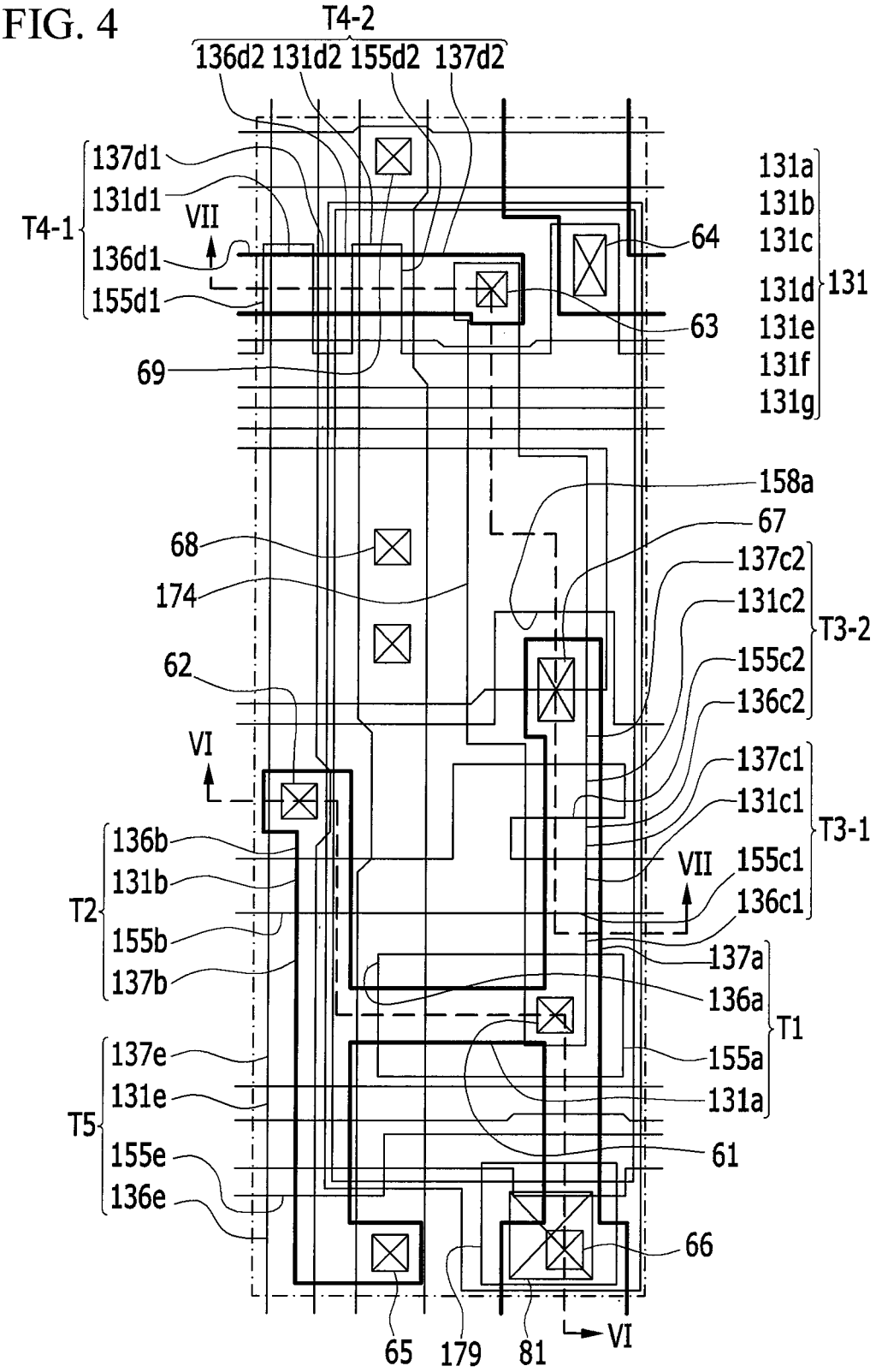
FIG. 4 is a detailed layout view of FIG. 3.
Figure 5:
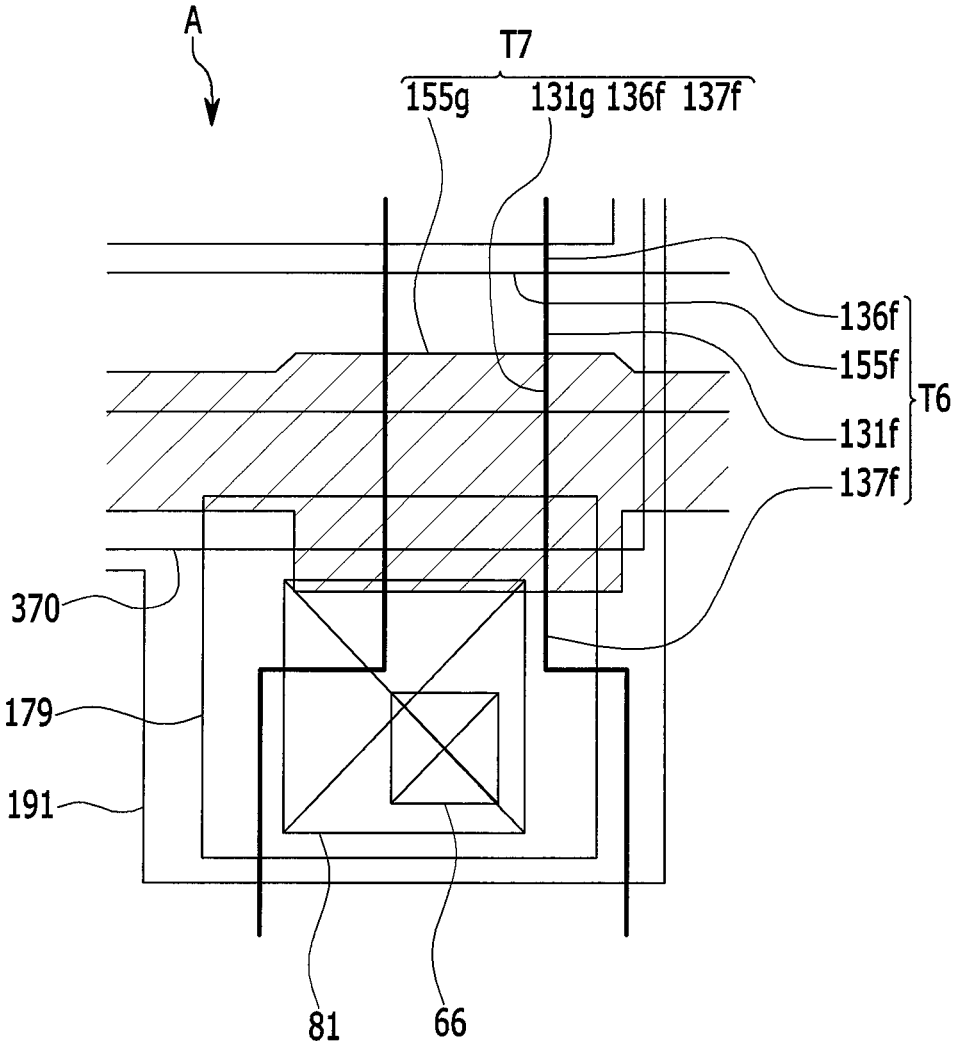
FIG. 5 is an enlarged layout view of the portion A of FIG. 3.
Figure 6:
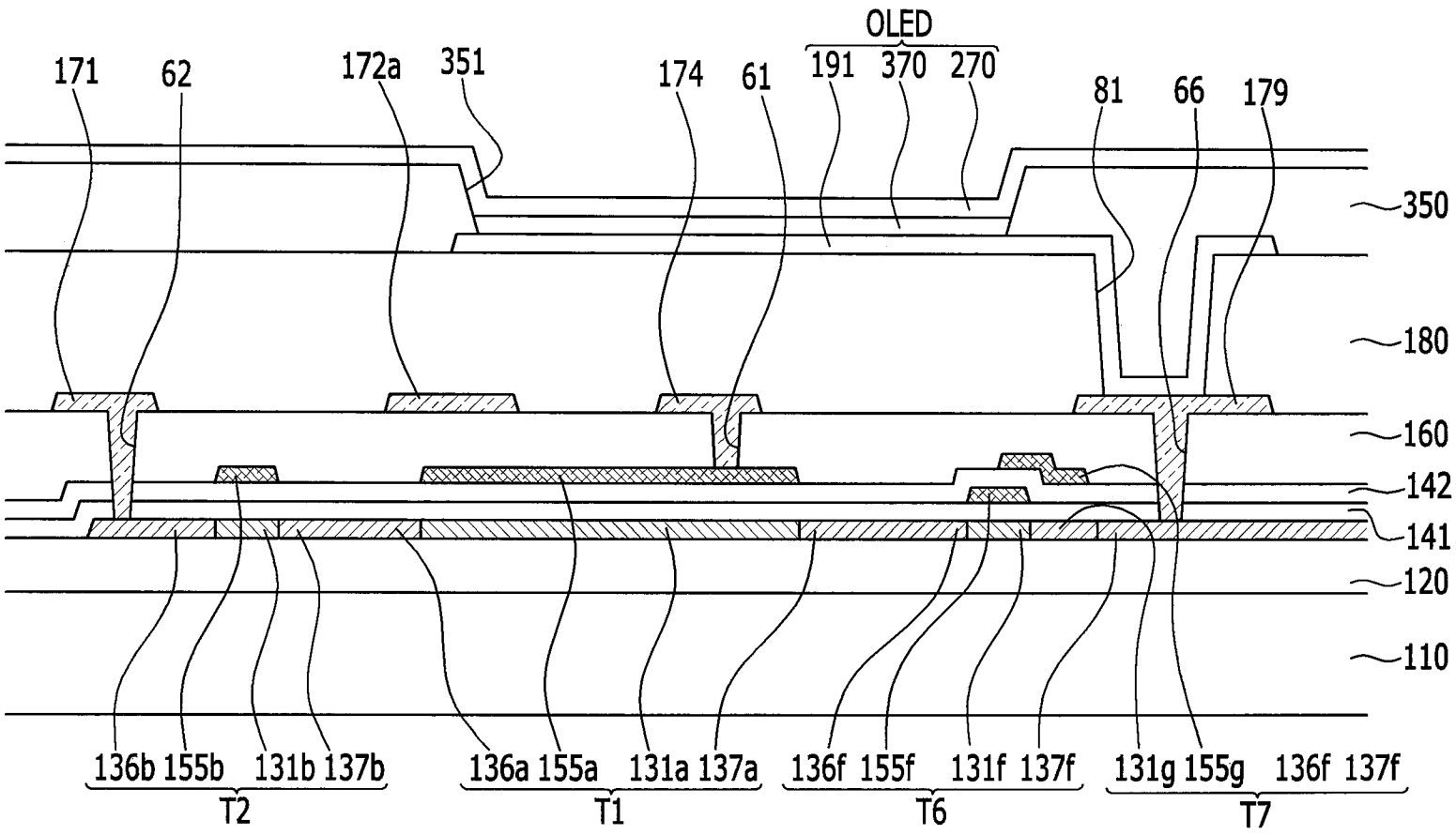
FIG. 6 is a cross-sectional view of the organic light emitting diode display of FIG. 4 taken along the line VI-VI.
Figure 7:
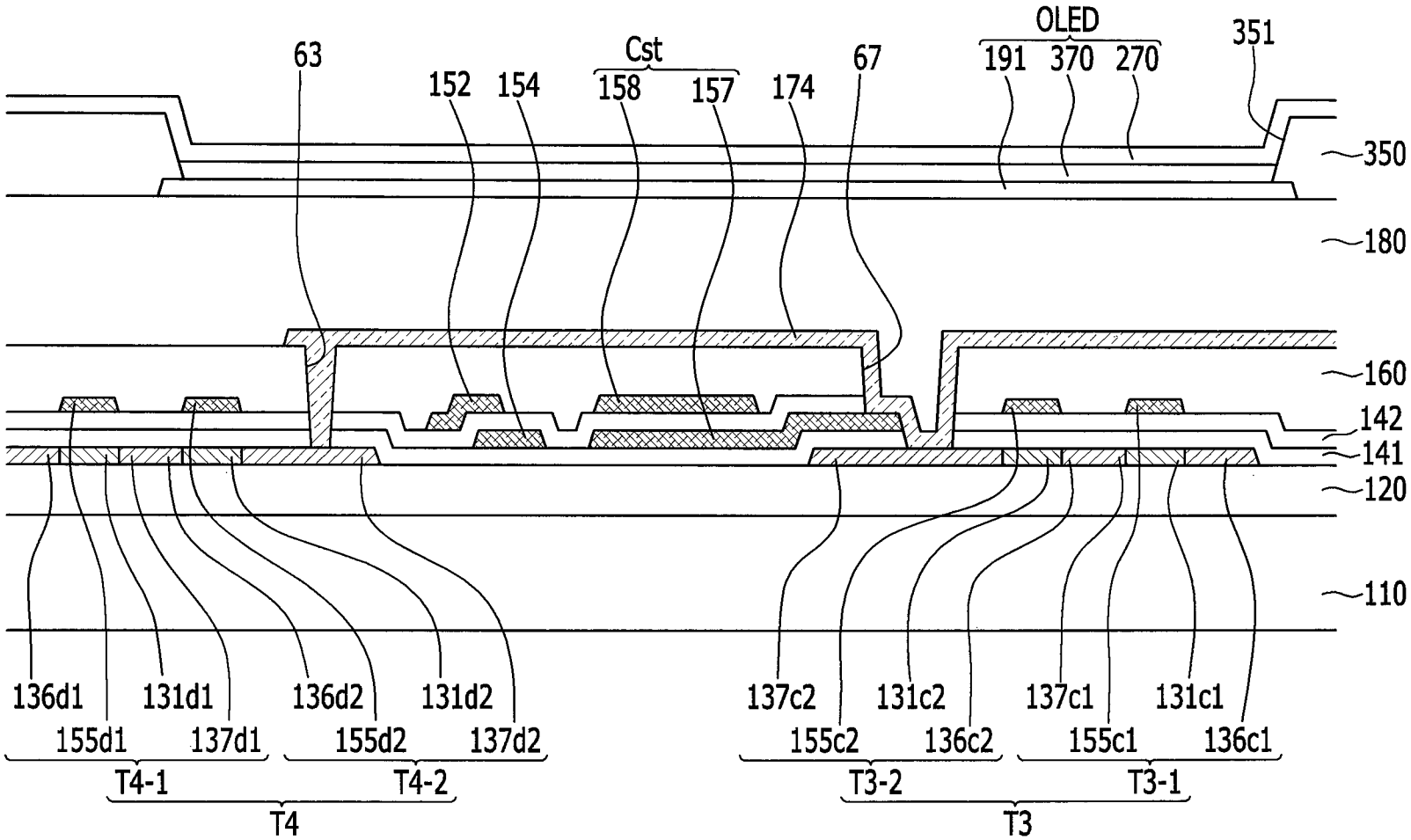
FIG. 7 is a cross-sectional view of the organic light emitting diode display of FIG. 4 taken along the line VII-VII.

FIG. 3 is a schematic view of a plurality of transistors and a capacitor of an organic light emitting diode display according to an exemplary embodiment of the present disclosure. FIG. 4 is a detailed layout view of FIG. 3. FIG. 5 is an enlarged layout view of the portion A of FIG. 3. FIG. 6 is a cross-sectional view of the organic light emitting diode display of FIG. 4 taken along the line VI-VI. FIG. 7 is a cross-sectional view of the organic light emitting diode display of FIG. 4 taken along the line VII-VII.

As shown in FIG. 3, the organic light emitting diode display according to an exemplary embodiment of the present disclosure includes the scan line 151, the previous scan line 152, the first emission control line 1531, the second emission control line 1532, and the initialization voltage line 154 for respectively applying the scan signal Sn, the previous scan signal Sn−1, the first emission control signal EM1, the second emission control signal EM2, and the initialization voltage Vint to the pixel, and extending along the row direction. In this case, the first emission control line 1531 and the second emission control line 1532 may partially overlap each other.

Also, the data line 171 and the driving voltage line 172 (e.g., a first driving voltage line 172*a* of the driving voltage line 172) crossing the scan line 151, the previous scan line 152, the first emission control line 1531, the second emission control line 1532, and the initialization voltage line 154, and for respectively applying the data signal Dm and the driving voltage ELVDD to the pixel, are further included. The driving voltage line 172 includes the first driving voltage line 172*a* parallel or substantially parallel to the data line 171, and a second driving voltage line 172*b* parallel or substantially parallel to the scan line 151. The first driving voltage line 172*a* is electrically connected to the second driving voltage line 172*b*.

Further, the pixel 1 includes the driving transistor T1, the switching transistor T2, the compensation transistor T3, the initialization transistor T4, the operation control transistor T5, the first emission control transistor T6, the second emission control transistor T7, the storage capacitor Cst, and the organic light emitting diode OLED including a pixel electrode 191, an organic emission layer 370, and a common electrode 270. In this case, the compensation transistor T3 and the initialization transistor T4 may be formed as dual gate transistors to prevent or substantially prevent a leakage current.

Each channels of the driving transistor T1, the switching transistor T2, the compensation transistor T3, the initialization transistor T4, the operation control transistor T5, the first emission control transistor T6, and the second emission control transistor T7 is formed in one semiconductor 130 connected thereto, and the semiconductor 130 may be curved having various shapes. The semiconductor 130 may be made of a polycrystalline semiconductor material or an oxide semiconductor material. The oxide semiconductor may include one of oxides from among titanium (Ti), hafnium (Hf), zirconium (Zr), aluminum (Al), tantalum (Ta), germanium (Ge), zinc (Zn), gallium (Ga), tin (Sn), and indium (In), or from among zinc oxide (ZnO), indium-gallium-zinc oxide (InGaZnO4), indium zinc oxide (Zn—In—O), zinc-tin oxide (Zn—Sn—O), indium gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium gallium oxide (In—Ge—Ga—O), titanium-indium-zinc oxide (Ti—In—Zn—O), and hafnium-indium-zinc oxide (Hf—In—Zn—O), which are complex oxides thereof. In the case when the semiconductor layer 130 is made of the oxide semiconductor, in order to protect the oxide semiconductor which may be vulnerable to an external environment, such as high temperature, a separate passivation layer may be further included.

The semiconductor layer 130 may include a channel region in which a channel is doped with an N-type impurity or a P-type impurity, and a source region and a drain region which are formed at respective sides of the channel region. The source region and the drain region may be formed by doping an impurity which is opposite to the impurity doped in the channel region. In the present exemplary embodiment, the source doping region and the drain doping region respectively correspond to the source electrode and the drain electrode. The source electrode and the drain electrode formed in the semiconductor 130 may be formed by only doping the corresponding regions. Also, in the semiconductor 130, the region between the source electrodes and the drain electrodes of the different transistors are also doped, such that the source electrode and the drain electrode are electrically connected to each other.

As shown in FIGS. 4 and 5, a channel 131 includes a driving channel 131*a* formed in the driving transistor T1, a switching channel 131*b* formed in the switching transistor T2, a compensation channel 131*c* formed in the compensation transistor T3, an initialization channel 131*d* formed in the initialization transistor T4, an operation control channel 131*e* formed in the operation control transistor T5, a first emission control channel 131*f* formed in the first emission control transistor T6, and a second emission control channel 131*g* formed in the second emission control transistor T7. Here, the first emission control channel 131*f* and the second emission control channel 131*g* overlap in a partial region.

The driving transistor T1 includes the driving channel 131*a*, a driving gate electrode 155*a*, a driving source electrode 136*a*, and a driving drain electrode 137*a*. The driving gate electrode 155*a* overlaps the driving channel 131*a*, and the driving source electrode 136*a* and the driving drain electrode 137*a* are respectively formed at sides of the driving channel 131*a*. The driving gate electrode 155*a* is connected to a first data connecting member 174 through a contact hole 61.

The switching transistor T2 includes the switching channel 131*b*, a switching gate electrode 155*b*, a switching source electrode 136*b*, and a switching drain electrode 137*b*. The switching gate electrode 155*b* is formed as a portion of the scan line 151 overlapping the portion of the switching channel 131*b*, and the switching source electrode 136*b* and the switching drain electrode 137*b* are respectively formed at sides of the switching channel 131*b* to be closed. The switching source electrode 136*b* is connected to the data line 171 through a contact hole 62.

Two compensation transistors T3 are formed to prevent or substantially prevent the leakage current, and include a first compensation transistor T3-1 and a second compensation transistor T3-2 formed to be adjacent to each other. The first compensation transistor T3-1 is positioned with reference to the scan line 151, and the second compensation transistor T3-2 is positioned with reference to a protrusion of the scan line 151. The first compensation transistor T3-1 includes a first compensation channel 131*c*1, a first compensation gate electrode 155*c*1, a first compensation source electrode 136*c*1, and a first compensation drain electrode 137*c*1. The second compensation transistor T3-2 includes a second compensation channel 131*c*2, a second compensation gate electrode 155*c*2, a second compensation source electrode 136*c*2, and a second compensation drain electrode 137*c*2.

The first compensation gate electrode 155*c*1 is formed as the portion of the scan line 151 overlapping the first compensation channel 131*c*1, and the first compensation source electrode 136*c*1 and the first compensation drain electrode 137*c*1 are formed at respective sides of the first compensation channel 131*c*1 to be adjacent thereto. The first compensation source electrode 136*c*1 is connected to the emission control source electrode 136*f* and the driving drain electrode 137*a*, and the first compensation drain electrode 137*c*1 is connected to the second compensation source electrode 136*c*2.

The second compensation gate electrode 155*c*2 is formed as a protrusion formed parallel to the scan line 121 that protrudes upwardly from the scan line 151 and overlaps the second compensation channel 131*c*2, and the second compensation source electrode 136*c*2 and the second compensation drain electrode 137*c*2 are formed at respective sides of the second compensation channel 131*c*2 to be adjacent.

The second compensation drain electrode 137*c*2 is connected to the first data connecting member 174 through a contact hole 67.

Two initialization transistors T4 are formed to prevent or substantially prevent the leakage current, and include a first initialization transistor T4-1 and a second initialization transistor T4-2 formed to be adjacent. The first initialization transistor T4-1 is positioned with reference to one protrusion of the previous scan line 152, and the second initialization transistor T4-2 is positioned with reference to another protrusion of the previous scan line 152. The first initialization transistor T4-1 includes a first initialization channel 131*d*1, a first initialization gate electrode 155*d*1, a first initialization source electrode 136*d*1, and a first initialization drain electrode 137*d*1. The second initialization transistor T4-2 includes a second initialization channel 131*d*2, a second initialization gate electrode 155*d*2, a second initialization source electrode 136*d*2, and a second initialization drain electrode 137*d*2.

The first initialization gate electrode 155*d*1 is formed as one protrusion of the previous scan line 152 that overlaps the first initialization channel 131*d*1, and the first initialization source electrode 136*d*1 and the first initialization drain electrode 137*d*1 are formed at respective sides of the first initialization channel 131*d*1 to be adjacent. The first initialization source electrode 136*d*1 is connected to the initialization voltage line 154 through a contact hole 64, and the first initialization drain electrode 137*d*1 is connected to the second initialization source electrode 136*d*2.

The second initialization gate electrode 155*d*2 is formed as the other protrusion of the previous scan line 152 overlapping the second initialization channel 131*d*2, and the second initialization source electrode 136*d*2 and the second initialization drain electrode 137*d*2 are formed at respective sides of the second initialization channel 131*c*2 to be adjacent. The second initialization drain electrode 137*d*2 is connected to the first data connecting member 174 through a contact hole 63.

As described above, the compensation transistor T3 is formed of the first compensation transistor T3-1 and the second compensation transistor T3-2, and the initialization transistor T4 is formed of the first initialization transistor T4-1 and the second initialization transistor T4-2, such that the electron moving path of the channels 131*c*1, 131*c*2, 131*d*1, and 131*d*2 is prevented or substantially prevented so the generation of the leakage current may be prevented or substantially prevented.

The operation control transistor T5 includes the operation control channel 131*e*, an operation control gate electrode 155*e*, an operation control source electrode 136*e*, and an operation control drain electrode 137*e*. The operation control gate electrode 155*e* is formed as the portion of the first emission control line 1531 overlapping the operation control channel 131*e*, and the operation control source electrode 136*e* and the operation control drain electrode 137*e* are formed at respective sides of the operation control channel 131*e* to be adjacent thereto. The operation control source electrode 136*e* is connected to the portion of the driving voltage line 172 through a contact hole 65.

As shown in FIG. 5, the first emission control transistor T6 includes the first emission control channel 131*f*, a first emission control gate electrode 155*f*, an emission control source electrode 136*f*, and an emission control drain electrode 137*f*. The first emission control gate electrode 155*f* is formed as the portion of the first emission control line 1531 overlapping the first emission control channel 131*f*. The second emission control transistor T7 includes the second emission control channel 131*g*, a second emission control gate electrode 155*g*, the emission control source electrode 136*f*, and the emission control drain electrode 137*f*. The second emission control gate electrode 155*g* is formed as the portion of the second emission control line 1532 overlapping the second emission control channel 131*g*. In this case, since the first emission control gate electrode 155*f* and the second emission control gate electrode 155*g* partially overlap each other in the partial region, the first emission control channel 131*f* and the second emission control channel 131*g* overlap each other through the partial region, such that the first emission control transistor T6 and the second emission control transistor T7 share the emission control source electrode 136*f* and the emission control drain electrode 137*f* with each other. Also, the emission control drain electrode 137*f* is connected to a second data connecting member 179 through a contact hole 66. As described above, by partially overlapping the second emission control line 1532 and the first emission control line 1531 with each other to prevent or substantially prevent the generation of the afterimage, the inner space of the pixel is decreased such that the size of the pixel may be minimized or reduced to have higher resolution.

One end of the driving channel 131*a* of the driving transistor T1 is connected to the switching drain electrode 137*b* and the operation control drain electrode 137*e*, and the other end of the driving channel 131*a* is connected to the compensation source electrodes 136*c*1 and 136*c*2 and the emission control source electrode 136*f*.

The storage capacitor Cst includes a first storage electrode 157 and a second storage electrode 158 with a second gate insulating layer 142 interposed therebetween. The first storage electrode 157 and the second storage electrode 158 overlap each other, and the second storage electrode 158 covers most of the first storage electrode 157. Here, the second gate insulating layer 142 becomes the dielectric material, and a storage capacitance is determined by the charge in the storage capacitor Cst, and the voltage between the two electrodes 157 and 158.

The first storage electrode 157 is connected to a center portion of the first data connecting member 174 through the contact hole 67, and the first data connecting member 174 is connected to the driving gate electrode 155*a* through the contact hole 61. Accordingly, the first storage electrode 157 is electrically connected to the driving gate electrode 155*a*. Also, the second storage electrode 158 is connected to the first driving voltage line 172*a* through a contact hole 68.

Accordingly, the storage capacitor Cst stores the storage capacitance corresponding to the difference between the driving voltage ELVDD transmitted to the second storage electrode 158 through the first driving voltage line 172*a* and the gate voltage Vg of the driving gate electrode 155*a*.

The first data connecting member 174 is formed to be parallel or substantially parallel to the data line 171. The upper portion of the first data connecting member 174 is connected to the second initialization drain electrode 137*d*2 through the contact hole 63, the center portion of the first data connecting member 174 is connected to the first storage electrode 157 and the second compensation drain electrode 137*c*2 through the contact hole 67, and the lower portion of the first data connecting member 174 is connected to the driving gate electrode 155*a* through the contact hole 61.

The second data connecting member 179 is connected to the pixel electrode 191 through a contact hole 81.

The second driving voltage line 172*b* is connected to the first driving voltage line 172*a* through a contact hole 69. As described above, the driving voltage line 172 may be formed of a mesh structure in which the first driving voltage line 172*a* in the vertical direction and the second driving voltage line 172*b* in the horizontal direction are connected to each other, thereby preventing or reducing the voltage drop of the driving voltage ELVDD.

Next, a cross-sectional structure of the organic light emitting diode (OLED) display according to an exemplary embodiment of the present disclosure will be described with reference to FIG. 6 and FIG. 7 according to a deposition order.

In this case, the operation control transistor T5 has the same deposition structure as the first emission control transistor T6, such that the detailed description thereof is omitted.

A buffer layer 120 may be formed on a substrate 110. The substrate 110 may be formed of an insulating substrate, such as glass, quartz, ceramic, and plastic, and the buffer layer 120 prevents or substantially prevents an impurity from the substrate 110 in a crystallization process to form a polycrystalline semiconductor, thereby improving a characteristic of the polycrystalline semiconductor and reducing a stress applied to the substrate 110.

The semiconductor 130 including the driving channel 131*a*, the switching channel 131*b*, the compensation channel 131*c*, the initialization channel 131*d*, the operation control channel 131*e*, the first emission control channel 131*f*, and the second emission control channel 131*g* is formed on the buffer layer 120. The driving source electrode 136*a* and the driving drain electrode 137*a* are formed at respective sides of the driving channel 131*a* among the semiconductor 130, and the switching source electrode 136*b* and the switching drain electrode 137*b* are formed at respective sides of the switching channel 131*b*. The first compensation source electrode 136*c*1 and the first compensation drain electrode 137*c*1 are formed at respective sides of the first compensation channel 131*c*1, the second compensation source electrode 136*c*2 and the second compensation drain electrode 137*c*2 are formed at respective sides of the second compensation channel 131*c*2, the first initialization source electrode 136*d*1 and the first initialization drain electrode 137*d*1 are formed at respective sides of the first initialization channel 131*d*1, and the second initialization source electrode 136*d*2 and the second initialization drain electrode 137*d*2 are formed at respective sides of the second initialization channel 131*d*2. The operation control source electrode 136*e* and the operation control drain electrode 137*e* are formed at respective sides of the operation control channel 131*e*, and the emission control source electrode 136*f* and the emission control drain electrode 137*f* are formed at respective sides of the first emission control channel 131*f* and the second emission control channel 131*g*.

A first gate insulating layer 141 covering the semiconductor 130 is formed thereon. First gate wirings 154, 1531, 155*e*, 155*f*, 157, and 172*b*, including the initialization voltage line 154, the first emission control line 1531 including the operation control gate electrode 155*e* and the first emission control gate electrode 155*f*, the first storage electrode 157, and the second driving voltage line 172*b*, is formed on the first gate insulating layer 141.

The second gate insulating layer 142 covering the first gate wiring 154, 1531, 155*e*, 155*f*, 157, and 172*b* and the first gate insulating layer 141 is formed thereon. The first gate insulating layer 141 and the second gate insulating layer 142 are formed of a silicon nitride (SiNx) or a silicon oxide (SiOx).

Second gate wirings 151, 152, 155*a*, 155*b*, 155*c*1, 155*c*2, 155*d*1, 155*d*2, 158, 155*g*, and 1532, including the scan line 151 including the driving gate electrode 155*a*, the switching gate electrode 155*b*, the first compensation gate electrode 155*c*1, and the second compensation gate electrode 155*c*2, the previous scan line 152 including the first initialization gate electrode 155*d*1 and the second initialization gate electrode 155*d*2, the second storage electrode 158, and the second emission control line 1532 including the second emission control gate electrode 155*g*, is formed on the second gate insulating layer 142.

An interlayer insulating layer 160 covering the second gate wiring 151, 152, 155*a*, 155*b*, 155*c*1, 155*c*2, 155*d*1, 155*d*2, 158, 155*g*, and 1532 and the second gate insulating layer 142 is formed thereon. The interlayer insulating layer 160 is formed of a silicon nitride (SiNx) or a silicon oxide (SiOx).

Data wiring 171, 172*a*, 174, and 179, including the data line 171, the first driving voltage line 172*a*, the first data connecting member 174, and the second data connecting member 179, is formed on the interlayer insulating layer 160.

The data line 171 is connected to the switching source electrode 136*b* through the contact hole 62 formed in the first gate insulating layer 141, the second gate insulating layer 142, and the interlayer insulating layer 160. The upper portion of the first data connecting member 174 is connected to the second initialization drain electrode 137*d*2 through the contact hole 63 formed in the first gate insulating layer 141, the second gate insulating layer 142, and the interlayer insulating layer 160. The center portion of the first data connecting member 174 is connected to the first storage electrode 157 and the second compensation drain electrode 137*c*2 through the contact hole 67 formed in the first gate insulating layer 141, the second gate insulating layer 142, and the interlayer insulating layer 160. The lower portion of the first data connecting member 174 is connected to the driving gate electrode 155*a* through the contact hole 61 formed in the interlayer insulating layer 160. In this case, the center portion of the first data connecting member 174 is connected to the first storage electrode 157 and the second compensation drain electrode 137*c*2 through a storage groove 158*a* formed in the second storage electrode 158.

The second data connecting member 179 having a quadrangle shape is connected to the emission control drain electrode 137*f* through the contact hole 66 formed in the first gate insulating layer 141, the second gate insulating layer 142, and the interlayer insulating layer 160.

A passivation layer 180 covering the data wiring 171, 172*a*, 174, and 179 and the interlayer insulating layer 160 is formed thereon. The passivation layer 180 may be formed of an organic layer. The pixel electrode 191 is formed on the passivation layer 180. The second data connecting member 179 is connected to the pixel electrode 191 through the contact hole 81 formed in the passivation layer 180.

A pixel defined layer (PDL) 350 covering the passivation layer 180 and the pixel electrode 191 is formed on edges of the passivation layer 180 and the pixel electrode 191. The pixel defined layer 350 has a pixel opening 351 that exposes the pixel electrode 191. The pixel defined layer 350 may be formed of resins, such as polyacrylate resin and polyimides, or silica-series inorganic materials.

The organic emission layer 370 is formed on the pixel electrode 191 exposed by the pixel opening 351, and the common electrode 270 is formed on the organic emission layer 370. As described above, the organic light emitting diode OLED including the pixel electrode 191, the organic emission layer 370, and the common electrode 270 is formed.

Herein, the pixel electrode 191 is an anode, which is a hole injection electrode, and the common electrode 270 is a cathode, which is an electron injection electrode. However, the present disclosure is not limited thereto, and according to some embodiments, the pixel electrode 191 may be the cathode and the common electrode 270 may be the anode according to a driving method of the organic light emitting diode display device. When holes and electrons are injected into the organic emission layer 370 from the pixel electrode 191 and the common electrode 270, respectively, and excitons acquired by combining the injected holes and electrons fall from an excitation state to a ground state, light is emitted.

The organic emission layer 370 may be formed of a low-molecular organic material or a high-molecular organic material such as poly(3,4-ethylenedioxythiophene) (PEDOT). Further, the organic emission layer 370 may be formed of multiple layers including at least one of an emission layer, a hole injection layer (HIL), a hole transporting layer (HTL), an electron transporting layer (ETL), and an electron injection layer (EIL). When the organic emission layer 370 includes all of these layers, the hole injection layer is disposed on the pixel electrode 191, which is the positive electrode, and the hole transporting layer, the emission layer, the electron transporting layer, and the electron injection layer are sequentially formed (e.g., laminated) thereon.

In some embodiments, the organic emission layer 370 may include a red organic emission layer for emitting red light, a green organic emission layer for emitting green light, and a blue organic emission layer for emitting blue light. The red organic emission layer, the green organic emission layer, and the blue organic emission layer may be formed at a red pixel, a green pixel, and a blue pixel, respectively, to display color images.

In some embodiments, in the organic emission layer 370, all of the red organic emission layer, the green organic emission layer, and the blue organic emission layer may be formed (e.g., laminated) together on the red pixel, the green pixel, and the blue pixel, and a red color filter, a green color filter, and a blue color filter may be formed for each pixel to display the color images. As another example, a white organic emission layer for emitting white light may be formed on all of the red pixel, the green pixel, and the blue pixel, and the red color filter, the green color filter, and the blue color filter may be formed for each pixel to display the color images. When the color images are displayed by using the white organic emission layer and the color filters, a deposition mask for depositing the red organic emission layer, the green organic emission layer, and the blue organic emission layer on individual pixels, that is, the red pixel, the green pixel, and the blue pixel, respectively, may not be used.

The white organic emission layer in another example may be formed by one organic emission layer, or may include a configuration that may emit white light by laminating a plurality of organic emission layers. As an example, the white organic emission layer may include a configuration that enables the white light to be emitted by combining at least one yellow organic emission layer and at least one blue organic emission layer, a configuration that enables the white light to be emitted by combining at least one cyan organic emission layer and at least one red organic emission layer, a configuration that enables the white light to be emitted by combining at least one magenta organic emission layer and at least one green organic emission layer, and the like.

An encapsulation member for protecting the organic light emitting diode OLED may be formed on the common electrode 270, and the encapsulation member may be sealed to the substrate 110 by a sealant. The encapsulation member may be formed of various materials, such as glass, quartz, ceramic, plastic, and a metal. On the other hand, a thin film encapsulation layer may be formed on the common electrode 270 by depositing the inorganic layer and the organic layer with the usage of the sealant.

Further, in the an exemplary embodiment, the second emission control transistor is formed to prevent or substantially prevent the afterimage. However in another exemplary embodiment, a holding capacitor including the emission control line and a holding electrode overlapping the holding capacitor may be formed to minimize or reduce the afterimage.

Next, an organic light emitting diode display according to another exemplary embodiment of the present disclosure will be described with reference to FIG. 8 to FIG. 11.

Figure 8:
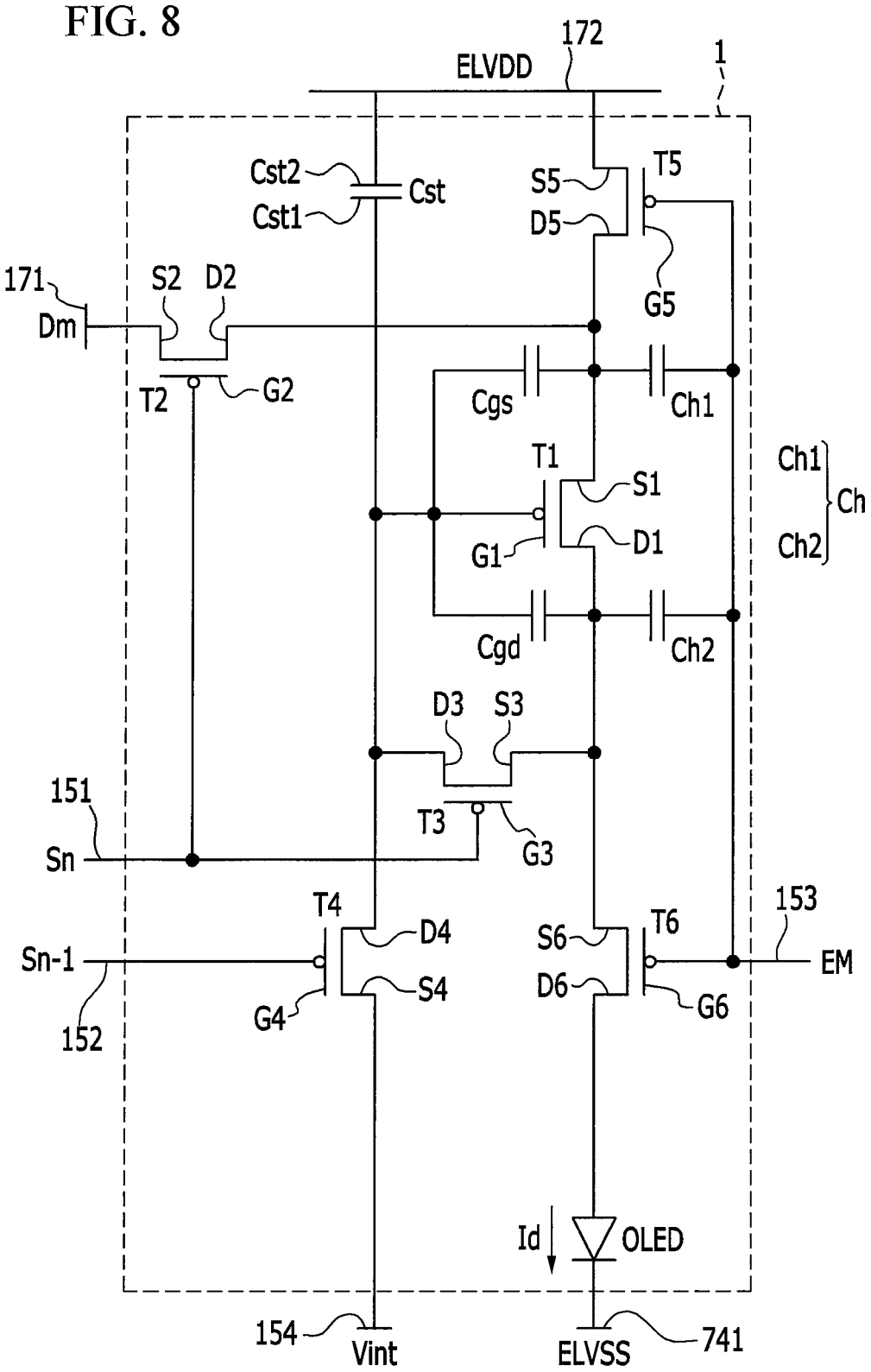
FIG. 8 is an equivalent circuit diagram of one pixel of an organic light emitting diode display according to another exemplary embodiment of the present disclosure.
Figure 9:
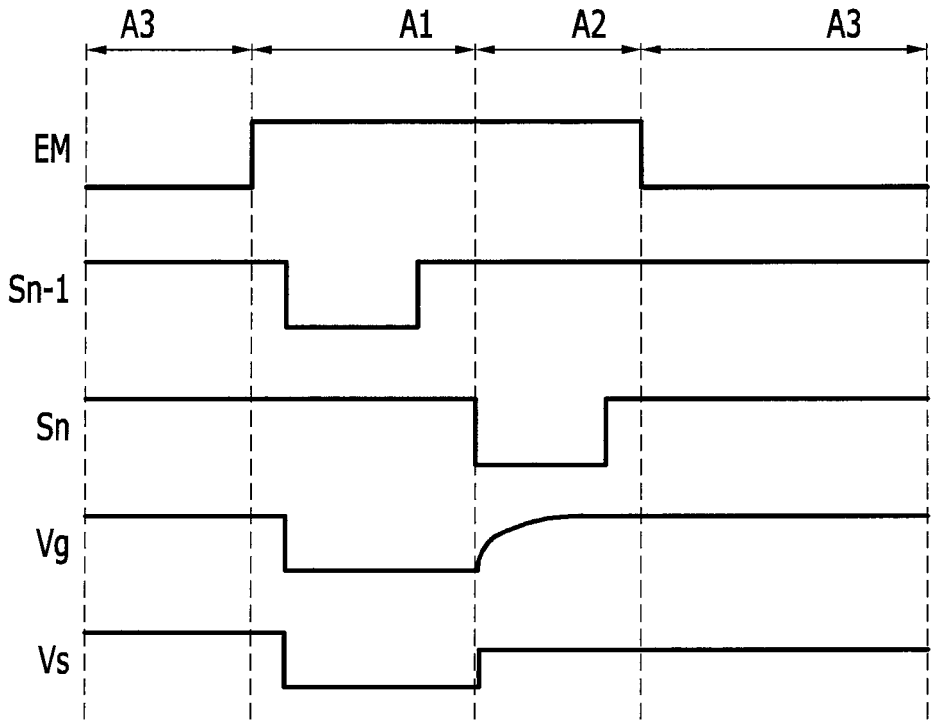
FIG. 9 is a timing diagram of signals applied to one pixel of an organic light emitting diode display according to another exemplary embodiment of the present disclosure.
Figure 10:
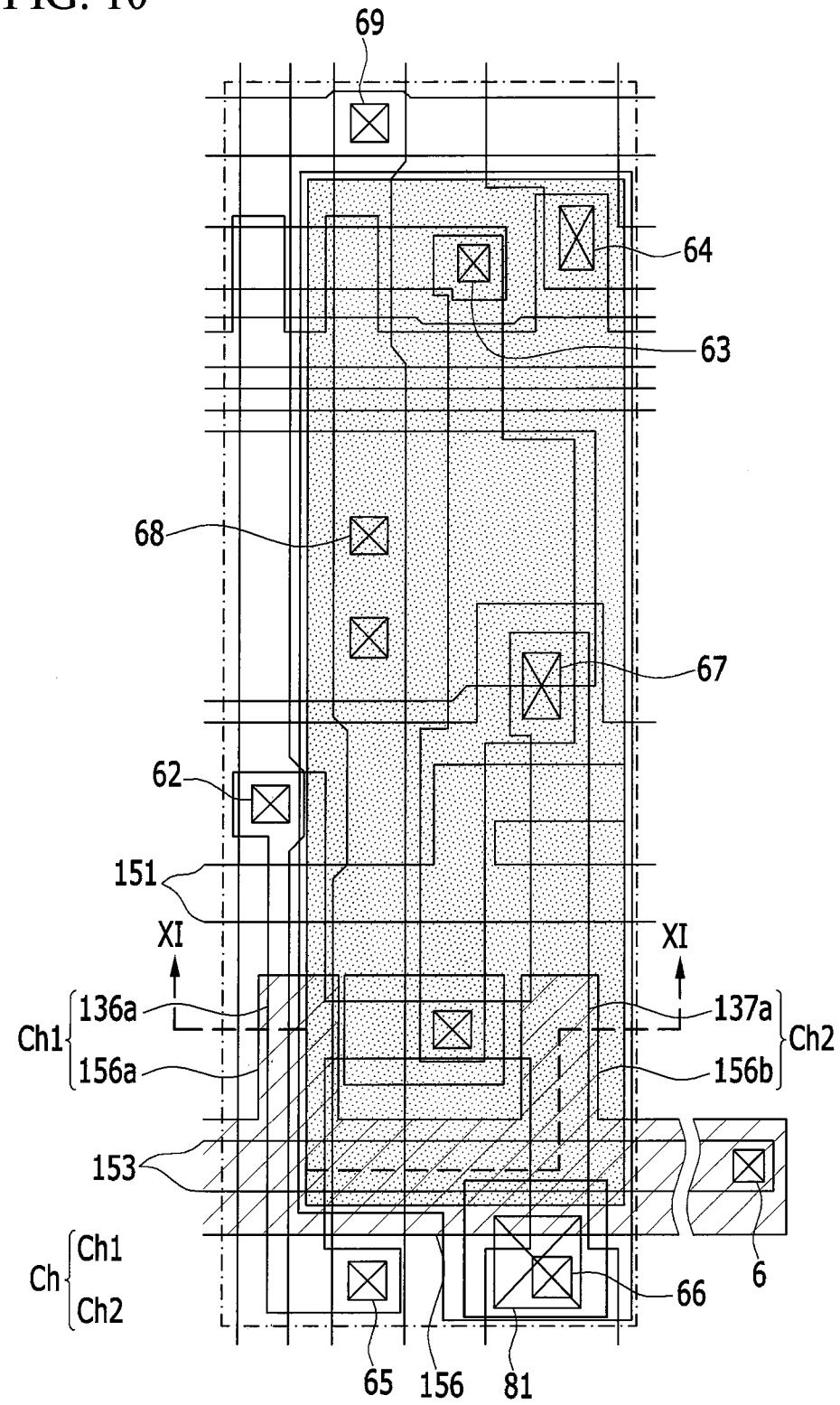
FIG. 10 is a detailed layout view of an organic light emitting diode display according to another exemplary embodiment of the present disclosure.
Figure 11:
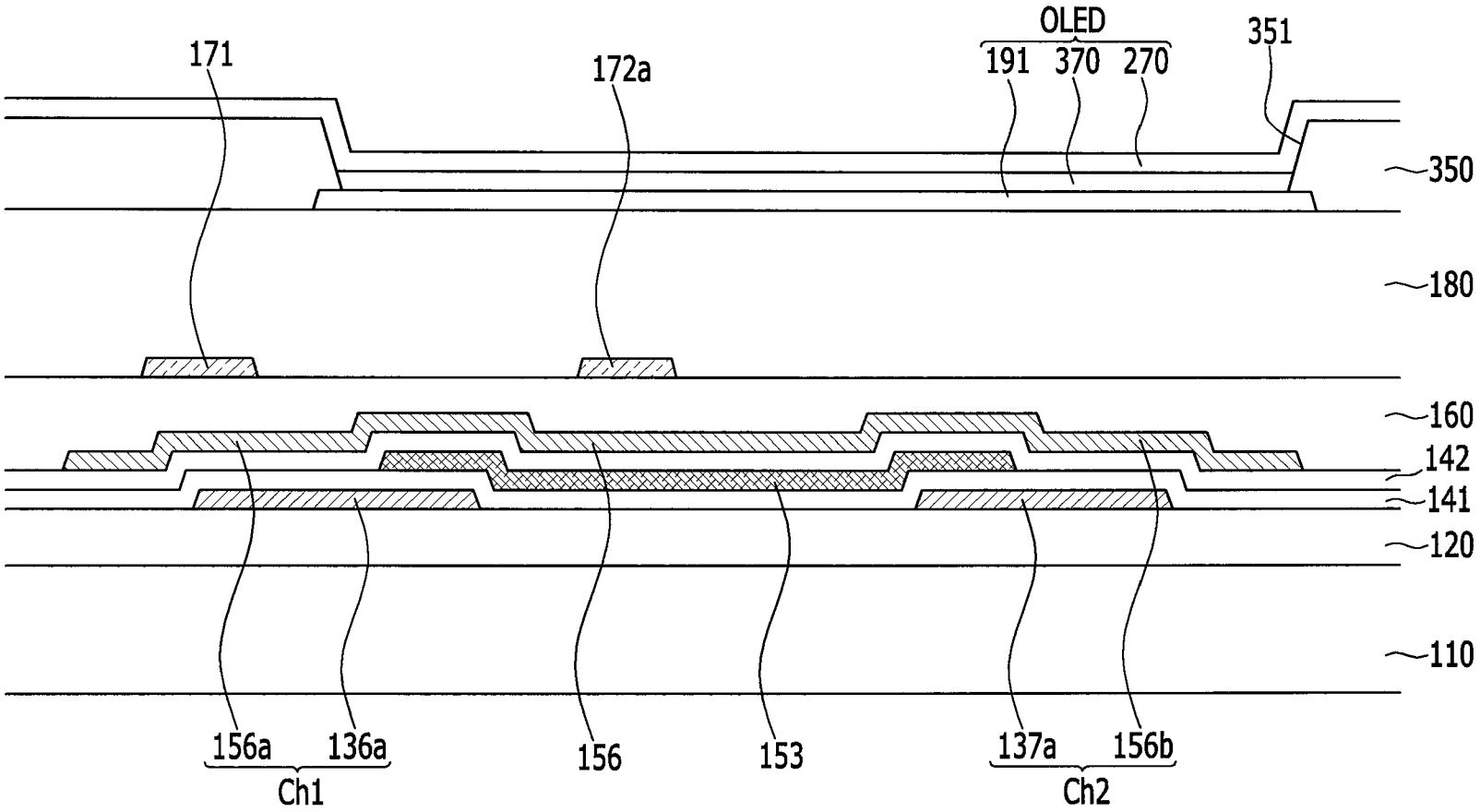
FIG. 11 is a cross-sectional view of the organic light emitting diode display of FIG. 10 taken along the line XI-XI.

FIG. 8 is an equivalent circuit diagram of one pixel of an organic light emitting diode display according to another exemplary embodiment of the present disclosure. FIG. 9 is a timing diagram of signals applied to the one pixel of an organic light emitting diode display according to another exemplary embodiment of the present disclosure. FIG. 10 is a detailed layout view of an organic light emitting diode display according to another exemplary embodiment of the present disclosure. FIG. 11 is a cross-sectional view of the organic light emitting diode display of FIG. 10 taken along the line XI-XI.

The exemplary embodiment shown in FIG. 8 to FIG. 11 is substantially the same as the exemplary embodiment shown in FIG. 1 to FIG. 7, except for the emission control line and the holding electrode.

As shown in FIG. 8, the organic light emitting diode display according to the present exemplary embodiment of the present disclosure includes the driving transistor T1, the switching transistor T2, the compensation transistor T3, the initialization transistor T4, the operation control transistor T5, the emission control transistor T6, the scan line 151, the previous scan line 152, an emission control line 153 for transmitting the emission control signal EM to the operation control transistor T5 and the emission control transistor T6, the initialization voltage line 154, the data line 171, and the driving voltage line 172.

The gate electrode G6 of the emission control transistor T6 is connected to the emission control line 153, the source electrode S6 of the emission control transistor T6 is connected to the drain electrode D1 of the driving transistor T1 and the source electrode S3 of the compensation transistor T3, and the drain electrode D6 of the emission control transistor T6 is electrically connected to the anode of the organic light emitting diode OLED.

A first holding capacitor Ch1 is formed between the source electrode S1 of the driving transistor T1 and the emission control line 153, and a second holding capacitor Ch2 is formed between the drain electrode D1 of the driving transistor T1 and the emission control line 153. A first parasitic capacitor Cgs is formed between the source electrode S1 and the gate electrode G1 of the driving transistor T1, and a second parasitic capacitor Cgd is formed between the drain electrode D1 and the gate electrode G1 of the driving transistor T1, such that the hysteresis of the driving transistor T1 is generated. However, since the first holding capacitor Ch1 and the second holding capacitor Ch2 prevents or reduces the change of the driving source voltage Vs by the first parasitic capacitor Cgs and the second parasitic capacitor Cgd, the driving channel is formed of the gate-source voltage Vgs of a large value in the driving transistor T1, thereby preventing or reducing the hysteresis of the driving transistor T1. This will be described in more detail with reference to FIG. 9.

As shown in FIG. 9, during an initializing period A1, the previous scan signal Sn−1 having a low level is supplied through the previous scan line 152. In this case, the emission control signal EM of the high level is previously applied through the emission control line 153. Then, the initializing transistor T4 is turned on in response to the previous scan signal Sn−1 having the low level, the initial voltage Vint is supplied to the gate electrode of the driving transistor T1 from the initialization voltage line 154 through the initializing transistor T4, and the driving transistor T1 is initialized by the initialization voltage Vint. In this case, the emission control signal EM of the high level is applied to the gate electrode G6 of the emission control transistor T6 such that the emission control transistor T6 is in a turn-off state.

The first holding capacitor Ch1 is formed at the source electrode S1 of the driving transistor T1, and the second holding capacitor Ch2 is formed at the drain electrode D1 of the driving transistor T1, such that the driving source voltage Vs is determined by a ratio of the first holding capacitor Ch1, the second holding capacitor Ch2, the first parasitic capacitor Cgs, and the second parasitic capacitor Cgd. As the first holding capacitor Ch1 and the second holding capacitor Ch2 have the large value, the driving source voltage Vs maintains or substantially maintains the high voltage.

Next, during a data programing period A2, the scan signal Sn of the low level is supplied through the scan line 151. Thus, the switching transistor T2 and the compensation transistor T3 are turned on corresponding to the scan signal Sn of the low level. At this time, the driving transistor T1 is diode-connected through the turned-on compensation transistor T3, and is biased in a forward direction.

Then, a compensation voltage Dm+Vth (Vth is a negative (−) value) that is reduced by a threshold voltage Vth of the driving transistor T1 from a data signal Dm supplied from the data line 171 is applied to the gate electrode of the driving thin film transistor T1. The driving voltage ELVDD and the compensation voltage (Dm+Vth) are applied to both terminals of the storage capacitor Cst, and a charge corresponding to the voltage difference between both terminals is stored in the storage capacitor Cst.

Next, during an emission period A3, the emission control signal EM supplied from the emission control line 153 is changed from the high level to the low level. Thus, the operation control transistor T5 and the emission control transistor T6 are turned on by the emission control signal EM of the low level during the emission period A3. Then, the driving current Id is generated according to the voltage difference between the gate voltage of the gate electrode G1 of the driving transistor T1 and the driving voltage ELVDD, and the driving current Id is supplied to the organic light emitting diode OLED through the emission control transistor T6. The gate-source voltage Vgs of the driving thin film transistor T1 is maintained or substantially maintained as "(Dm+Vth)-ELVDD" by the storage capacitor Cst for the emission period, according to the current-voltage relationship of the driving transistor T1, and the driving current Id is proportional to the square "$(Dm\text{-}ELVDD)^2$" of a value obtained by subtracting the threshold voltage from the source-gate voltage. Accordingly, the driving current Id is determined regardless of the threshold voltage Vth of the driving thin film transistor T1.

During the emission period A3, the driving source voltage Vs also maintains or substantially maintains the voltage (e.g., the predetermined voltage) by the first holding capacitor Ch1 and the second holding capacitor Ch2, such that the driving transistor T1 maintains or substantially maintains the state in which the driving channel is formed with the gate-source voltage Vgs of the predetermined value. Accordingly, the hysteresis and the afterimage generated by the first parasitic capacitor Cgs and the second parasitic capacitor Cgd may be minimized or reduced.

Next, a detailed structure of the pixel of the organic light emitting diode display shown in FIG. 8 will be described with reference to FIG. 8, FIG. 10, and FIG. 11.

As shown in FIG. 10, the emission control line 153 is formed to extend along the row direction, and is parallel or substantially parallel to the scan line 151. A holding electrode line 156 overlaps the emission control line 153, and the holding electrode line 156 is connected to the emission control line 153 through a contact hole 6. Accordingly, the emission control signal EM flowing to the emission control line 153 is also transmitted to the holding electrode line 156. A first holding electrode 156*a* and a second holding electrode 156*b* protrude upwardly from the holding electrode line 156. The first holding electrode 156*a* overlaps the driving source electrode 136*a*, and the second holding electrode 156*b* overlaps the driving drain electrode 137*a*. The first holding electrode 156*a* and the driving source electrode 136*a* form the first holding capacitor Ch1 via the second gate insulating layer 142 interposed therebetween, and the second holding electrode 156*b* and the driving drain electrode 137*a* form the second holding capacitor Ch2 via the second gate insulating layer 142 interposed therebetween.

The holding capacitor Ch including the first holding capacitor Ch1 and the second holding capacitor Ch2 may minimize or reduce the hysteresis and the afterimage generated by the first parasitic capacitor Cgs and the second parasitic capacitor Cgd.

As shown in FIG. 11, the buffer layer 120 is formed on the substrate 110, and the semiconductor 130, including the driving channel 131*a*, the switching channel 131*b*, the compensation channel 131*c*, the initialization channel 131*d*, the operation control channel 131*e*, and the emission control channel 131*f*, is formed on the buffer layer 120. The first gate insulating layer 141 covering the semiconductor 130 is formed thereon. The first gate wiring 155*a*, 154, 153, 155*e*, 155*f*, 157, and 172*b*, including the driving gate electrode 155*a*, the initialization voltage line 154, the emission control line 153 including the operation control gate electrode 155*e* and the emission control gate electrode 155*f*, the first storage electrode 157, and the second driving voltage line 172*b*, is formed on the first gate insulating layer 141.

The second gate insulating layer 142 covering the first gate wiring 155*a*, 154, 153, 155*e*, 155*f*, 157, and 172*b* and the first gate insulating layer 141 is formed thereon. The second gate wiring 151, 152, 155*b*, 155*c*1, 155*c*2, 155*d*1, 155*d*2, 158, 156*a*, 156*b*, and 156, including the switching gate electrode 155*b*, the scan line 151 including the first compensation gate electrode 155*c*1 and the second compensation gate electrode 155*c*2, the previous scan line 152 including the first initialization gate electrode 155*d*1 and the second initialization gate electrode 155*d*2, the second storage electrode 158, and the holding electrode line 156 including the first holding electrode 156*a* and the second holding electrode 156*b*, is formed on the second gate insulating layer 142.

The electrical and electronic devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or the like. Further, the various components of these devices may be a process or thread, running on one or more processors, in one or more computing devices, executing computer program instructions and interacting with other system components for performing the various functionalities described herein. The computer program instructions may be stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

While the present disclosure has been described with reference to the exemplary embodiments disclosed herein, it is to be understood that the present invention is not limited to these disclosed embodiments, but is intended to cover various modifications and equivalent arrangements included within the spirit and scope of the appended claims, and their equivalents.

DESCRIPTION OF SOME OF THE REFERENCE NUMBERS

| | |
|---|---|
| 131a: driving channel | 131b: switching channel |
| 131f: emission control channel, first emission control channel | |
| 131g: second emission control channel | |
| 141: first gate insulating layer | 142: second gate insulating layer |
| 151: scan line | 152: previous scan line |
| 1531: first emission control line | 1532: second emission control line |
| 154: initialization voltage line | 155a: driving gate electrode |
| 155b: switching gate electrode | 156: holding electrode line |
| 160: interlayer insulating layer | 171: data line |
| 172: driving voltage line | |

What is claimed is:

1. An organic light emitting diode display comprising:

a substrate;

a scan line, a first emission control line, and a second emission control line on the substrate and respectively configured to transmit a scan signal, a first emission control signal, and a second emission control signal;

a data line and a driving voltage line crossing the scan line, the data line and the driving voltage line being respectively configured to transmit a data voltage and a driving voltage;

a switching transistor connected to the scan line and the data line and comprising a switching drain electrode configured to output the data voltage;

a driving transistor comprising a driving source electrode connected to the switching drain electrode;

an organic light emitting diode electrically connected to a driving drain electrode of the driving transistor;

an operation control transistor configured to be turned on by the first emission control signal and to transmit the driving voltage to the driving transistor; and a first emission control transistor and a second emission control transistor respectively configured to be turned on by the first emission control signal and the second emission control signal, and to transmit the driving voltage from the driving transistor to the organic light emitting diode, wherein the first emission control line and the second emission control line partially overlap each other.

2. The organic light emitting diode display of claim 1, wherein the second emission control line is between the first emission control line and the organic light emitting diode.

3. The organic light emitting diode display of claim 2, wherein the second emission control transistor is configured to receive the second emission control signal having a high level through the second emission control line during an initialization period in which the driving transistor is initialized to turn off the second emission control transistor.

4. The organic light emitting diode display of claim 1, further comprising a storage capacitor comprising a first storage electrode connected to a driving gate electrode of the driving transistor, and a second storage electrode connected to the driving voltage line, wherein the first emission control line is at a same layer as the first storage electrode.

5. The organic light emitting diode display of claim 4, wherein the second emission control line is at a same layer as the scan line.

6. The organic light emitting diode display of claim 4, wherein the second storage electrode and the driving gate electrode are at a same layer as the scan line.

7. The organic light emitting diode display of claim 1, wherein a first emission control gate electrode of the first emission control transistor and a second emission control gate electrode of the second emission control transistor partially overlap each other.

8. An organic light emitting diode display comprising:

a substrate;

a scan line and an emission control line on the substrate and respectively configured to transmit a scan signal and an emission control signal;

a data line and a driving voltage line crossing the scan line, the data line and the driving voltage line being respectively configured to transmit a data voltage and a driving voltage;

a switching transistor connected to the scan line and the data line and comprising a switching drain electrode configured to output the data voltage;

a driving transistor comprising a driving source electrode connected to the switching drain electrode;

an organic light emitting diode electrically connected to a driving drain electrode of the driving transistor;

an operation control transistor configured to be turned on by the emission control signal and to transmit the driving voltage to the driving transistor;

an emission control transistor configured to be turned on by the emission control signal and to transmit the driving voltage from the driving transistor to the organic light emitting diode; and a holding electrode line including a holding electrode overlapping the driving source electrode and the driving drain electrode, wherein the driving source electrode, the driving drain electrode, and the holding electrode, form a holding capacitor.

9. The organic light emitting diode display of claim 8, wherein the holding electrode line is connected to the emission control line.

10. The organic light emitting diode display of claim 8, further comprising:

a storage capacitor comprising a first storage electrode connected to a driving gate electrode of the driving transistor, and a second storage electrode connected to the driving voltage line, wherein the emission control line is at a same layer as the first storage electrode.

11. The organic light emitting diode display of claim 10, wherein the holding electrode line is at a same layer as the second storage electrode.

12. The organic light emitting diode display of claim 11, wherein the driving gate electrode is at a same layer as the emission control line.

13. The organic light emitting diode display of claim 8, wherein the holding electrode includes a first holding electrode overlapping the driving source electrode and a second holding electrode overlapping the driving drain electrode, wherein the holding capacitor comprises a first holding capacitor between the driving source electrode and the first holding electrode, and a second holding capacitor between the driving drain electrode and the second holding electrode.

* * * * *